US009995496B2

(12) United States Patent
Lord et al.

(10) Patent No.: US 9,995,496 B2
(45) Date of Patent: Jun. 12, 2018

(54) CONTROL OF A CONDITIONED AIR SUPPLY SYSTEM

(75) Inventors: Richard G. Lord, Murfreesboro, TN (US); Guy A. DeLuca, Kennesaw, GA (US); Michael J. Froehlich, Baldwinsville, NY (US)

(73) Assignee: CARRIER CORPORATION, Farmington, CT (US)

( * ) Notice: Subject to any disclaimer, the term of this patent is extended or adjusted under 35 U.S.C. 154(b) by 1387 days.

(21) Appl. No.: 13/121,473

(22) PCT Filed: Sep. 29, 2009

(86) PCT No.: PCT/US2009/058748

§ 371 (c)(1),
(2), (4) Date: Mar. 29, 2011

(87) PCT Pub. No.: WO2010/039691

PCT Pub. Date: Apr. 8, 2010

(65) Prior Publication Data

US 2011/0173999 A1 Jul. 21, 2011

Related U.S. Application Data

(60) Provisional application No. 61/101,383, filed on Sep. 30, 2008.

(51) Int. Cl.

| | |
|---|---|
| ***F24F 11/00*** | (2018.01) |
| ***F24F 3/048*** | (2006.01) |
| ***F24F 3/14*** | (2006.01) |

(52) U.S. Cl.

CPC ..... *F24F 3/048* (2013.01); *F24F 3/14* (2013.01); *F24F 11/006* (2013.01); *F24F 11/00* (2013.01); *F24F 11/0012* (2013.01); *F24F 11/0015* (2013.01)

(58) Field of Classification Search

CPC ..... F24F 11/0076; F24F 11/053
USPC ..... 62/176.2, 180, 186; 236/49.3, 44 C; 165/217, 223, 289

See application file for complete search history.

(56) References Cited

U.S. PATENT DOCUMENTS

| | | | | |
|---|---|---|---|---|
| 4,399,862 | A * | 8/1983 | Hile | 165/253 |
| 4,480,783 | A | 11/1984 | Clark | |
| 4,540,118 | A | 9/1985 | Lortie et al. | |
| 4,649,710 | A * | 3/1987 | Inoue et al. | 62/92 |
| 4,947,928 | A | 8/1990 | Parker et al. | |
| 5,180,102 | A | 1/1993 | Gilbert et al. | |
| 5,544,697 | A | 8/1996 | Clark | |
| 5,863,246 | A | 1/1999 | Bujak, Jr. | |
| 6,786,056 | B2 * | 9/2004 | Bash et al. | 62/199 |
| 7,669,431 | B2 * | 3/2010 | Bash et al. | 62/178 |

(Continued)

OTHER PUBLICATIONS

Sequence of Operation, Air Handling Units—Variable Air Volume, Document: SEQOP AHU-VAV rev3 Jan. 7, 2008; Revision: 3, Date: Jan. 7, 2008, Penn State, Office of Physical Plant, Energy and Engineering Division, Engineering Services, 8 pages.

(Continued)

*Primary Examiner* — Ljiljana Ciric
*Assistant Examiner* — Alexis Cox
(74) *Attorney, Agent, or Firm* — Cantor Colburn LLP

(57) ABSTRACT

An air supply system and a method for controlling operation of an air supply system for supplying a conditioned air flow at a setpoint air temperature to a climate controlled space.

13 Claims, 4 Drawing Sheets

(56) References Cited

U.S. PATENT DOCUMENTS

| | | | | |
|---|---|---|---|---|
| 8,495,888 | B2 * | 7/2013 | Seem | 62/186 |
| 8,515,585 | B2 * | 8/2013 | Uraki et al. | 700/276 |
| 2004/0177630 | A1 * | 9/2004 | Umebayashi et al. | 62/186 |
| 2005/0278070 | A1 * | 12/2005 | Bash et al. | 700/276 |
| 2006/0225446 | A1 * | 10/2006 | Bash et al. | 62/178 |
| 2007/0205294 | A1 * | 9/2007 | Byczynski et al. | 236/44 C |
| 2008/0104987 | A1 * | 5/2008 | Carlsen et al. | 62/272 |
| 2009/0166442 | A1 * | 7/2009 | Stark | 236/1 B |
| 2013/0186965 | A1 * | 7/2013 | Wang et al. | 236/44 C |

OTHER PUBLICATIONS

Design Guideline—Displacement Ventilation Design Guide: K-12 Schools, Final Report, Prepared for: California Energy Commission, Jun. 2006, PIER IEQ-K12, 66 pages.

Turner Building Science LLC., HVAC Design—Displacement Ventilation, http://www.turnerbuildingscience.com/disp.htm, 7 pages.

* cited by examiner

CONTROL OF A CONDITIONED AIR SUPPLY SYSTEM

FIELD OF THE INVENTION

This invention relates generally to the supply of conditioned air to a climate controlled space and, more particularly, to a method for controlling the supply of conditioned air to a climate controlled space in response to space temperature and space relative humidity.

BACKGROUND OF THE INVENTION

Conventional systems for supplying conditioned air from a central source to a one or more climate controlled spaces, such as offices, classrooms, and other areas that may from time to time be occupied, commonly use variable air volume (VAV) distribution. Such VAV systems include a variable capacity refrigerant vapor compression system and a variable speed fan. The refrigerant vapor compression system includes a compressor that circulates cold refrigerant through a heat exchanger coil in heat exchange relationship with air passing over the coil to cool the air to be supplied to the climate controlled space to a preset air supply temperature. The speed of the variable speed fan is varied between its lower and upper speed limits to vary the volume of air supplied through a ductwork system to the climate controlled space. Typically, the speed of the fan is varied in response to duct air pressure to maintain a desired static pressure head to ensure adequate distribution of the air through ducts to a plurality of areas within the climate controlled space. In conventional VAV systems, air terminals equipped with dampers controlled by actuators responsive to room temperature are associated with the supply air registers. The actuator selectively positions its associated damper at a desired position between fully open and minimum ventilation position to control the amount of cold air from the supply duct into the room.

In conventional or mixed air distribution systems commonly associated with conventional VAV systems, the cold air being supplied to the rooms and other areas within the climate controlled space is admitted through registers disposed in or near the ceiling of those areas, while return air is drawn from those areas through return registers in or near the ceiling thereof.

The same HVAC equipment can also be used in what is often referred to as a single zone VAV system. In the single zone VAV system the refrigeration capacity is controlled to supply constant temperature air and the volume of air is varied to control the temperature of the room. The same equipment can also be used in a thermal displacement ventilation system. In thermal displacement ventilation air distribution systems, the cold air being supplied to the climate controlled space is admitted through registers disposed in or near the floor of the space, while return air is drawn from the space through return registers in or near the ceiling of the space.

In operation of such VAV systems, the ability to optimally control the comfort temperature and also humidity within the climate controlled space may be limited at times of high cooling demand, such as during periods of high occupancy and/or high outdoor temperature and humidity, because air supply temperature and fan speed are controlled to a fixed setpoint. Also with fixed setpoint control, the air may not be optimally dehumidified resulting in a high humidity level in the space or the expenditure of excess energy to overly dehumidify the space.

SUMMARY OF THE INVENTION

A method is provided for controlling operation of a system for supplying a conditioned air flow at a setpoint air temperature to a climate controlled space. The method includes the steps of: operating the system under a first control mode in response to a sensed space air temperature by varying a flow volume of the conditioned air flow and maintaining the air temperature of the conditioned air constant at the setpoint air temperature; and operating the system under a second control mode in response to the sensed space air temperature by varying the setpoint air temperature of the conditioned air flow and maintaining the flow volume of the conditioned air constant.

In an embodiment, the method includes the further step of operating the system under a third control mode in response to a sensed space relative humidity by incrementally varying the setpoint air temperature for the conditioned air flow supply. In an embodiment, the method includes the further step of: operating the system under a third control mode both in response to a sensed space relative humidity by incrementally varying the setpoint air temperature of the conditioned air flow and in response to the sensed space air temperature by varying a flow volume of the conditioned air flow. In an embodiment, the method includes sequentially operating said system under the first control mode and then under the second control mode; and transitioning operation under either of the first control mode and the second control mode to the third control mode in response to a demand for dehumidifying the air within the climate controlled space.

In an embodiment, the method may also include the steps of: admitting the supply flow of conditioned air into a lower region of the climate controlled space; and withdrawing a return flow of air from an upper region of the climate controlled space. The supply flow of conditioned may be admitted into the lower region of the climate controlled space at a low air velocity over a floor of the climate controlled space thereby flooding the lower region of the climate controlled space.

An air supply system is provided for controlling the supply of conditioned air to a climate-controlled space includes an air supply unit having an air mover and a heat exchanger for conditioning the conditioned air, an air supply duct connecting the air supply unit in air flow communication with the space, an air return duct connecting the space in air flow communication within with the air supply unit, and a controller operatively associated with the air mover and the heat exchanger for controlling the air flow volume of the conditioned air passed to the air supply duct and for controlling the temperature of the conditioned air to a setpoint temperature, each in response to a sensed space air temperature. In an embodiment, the controller adjusts the setpoint temperature for the conditioned air in response to a dehumidification demand to increase dehumidifying of the conditioned air and adjusts the air flow volume of conditioned air passed to the supply duct in response to the sensed air temperature in the space. In an embodiment, the controller adjusts the setpoint temperature for the conditioned air in response to an over dehumidification to decrease dehumidifying of the conditioned air and adjusts the air flow volume of conditioned air passed to the supply duct in response to the sensed air temperature in the space.

In an embodiment, the system may include at least one air inlet opening to the air supply duct and disposed in the space to admit the conditioned air into a lower region of the space. In an embodiment, the system may include at least one air inlet opening to the air supply duct and disposed in the space to admit the conditioned air into an upper region of the space. The system may include at least one air outlet opening to the air return duct and disposed in the space to withdraw air from an upper region of the space.

BRIEF DESCRIPTION OF THE DRAWING

For a further understanding of the invention, reference will be made to the following detailed description of the invention which is to be read in connection with the accompanying drawing, where.

DETAILED DESCRIPTION OF THE INVENTION

Figure 1:
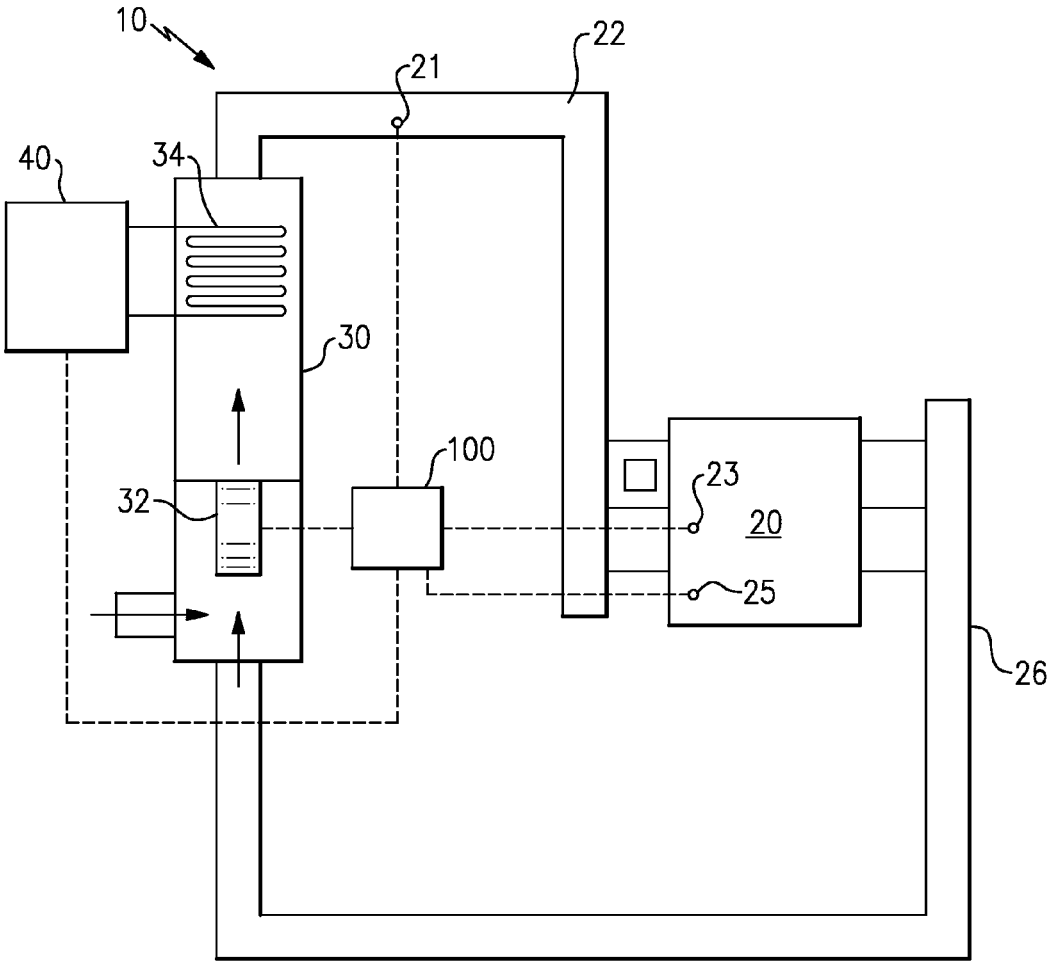
FIG. 1 is a schematic diagram of a system for supplying conditioned air to a climate controlled space.
Figure 2:
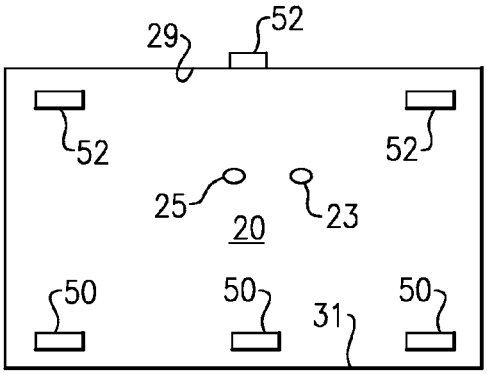
FIG. 2 is elevation view of a wall within the climate controlled space.

Referring initially to FIGS. 1 and 2, there is depicted an exemplary embodiment of a system 10 for supplying conditioned air to a plurality of climate controlled space 20. The system 10 includes an air handler 30, a supply air duct 22 which connects the air handler 30 in air flow communication with a plurality of supply air registers, and a return air duct 26 which connects return air registers in the space 20 in air flow communication with the air handler 30

Referring now to FIG. 2, in the depicted thermal displacement embodiment of the conditioned air supply system 10, the air inlet registers 50 from the supply air duct 22 are disposed in the walls of the climate controlled space 20 near the floor 31 or in the floor, while the air outlet registers 52 to the return air duct 26 are disposed in walls near the ceiling 29 of the climate control space or in the ceiling. With the air inlet registers 50 so positioned near the floor 31, the supply air is introduced through the air inlet registers 50 at a low velocity so as flow along the floor and flood the lower portion of the climate controlled space with a layer of relatively cool supply air. The supplied air will migrate upwardly and gradually mix with and displace the air within the climate controlled space upwardly to flow out of the outlet registers 52 into the return air duct 26. In this manner, a vertical temperature gradient is established within the climate controlled space 20. Temperature sensor 23, for example a thermostat, and relative humidity sensor 25, for example a humidistat, may be disposed in the climate controlled space, for example on the wall at conventional height above the floor, to sense, respectively, the comfort air temperature and the relative humidity within the climate controlled space.

The air handler 30 includes a variable speed fan 32 disposed in an inlet plenum and a heat exchanger coil 34, disposed in an outlet plenum, which is traversed by the air passing through the air handler 30. In some circumstances, outdoor air may be admitted into the inlet plenum of the air handler 30 to mix with the return air entering the inlet plenum from the return air duct 26. In traversing the heat exchanger 34, the air passes in heat exchange relationship with a cooling medium and is cooled to a preset supply air setpoint temperature. The cooling medium may be refrigerant supplied from a refrigerant vapor compression system 40 operatively associated with the heat exchanger 34. In an embodiment, the refrigeration vapor compression system 40 may include a variable or stepped capacity compressor or multiple compressors (not shown). However, other cooling medium, such as chilled water from a chiller, may be used.

The conditioned air supply system 10 also includes a controller 100 that controls operation of the air handler 30 as well as the operation of the refrigerant vapor compression system 40. The controller 100 controls the operation of the refrigerant vapor compression system 40 by modulating the refrigerant flow (therefor cooling capacity) to maintain the supply air temperature, SAT, that is the temperature of the conditioned air having traversed the heat exchanger coil 34 and flowing through the supply duct 22 equal to the supply air temperature setpoint, SATSP. The controller 100 also monitors various system operating parameters including, among other parameters sensed in conventional practice, space air temperature and space relative humidity. For example, the controller 100 may monitor temperature sensor 21 for sensing the supply air temperature, SAT, in the supply air duct 22, thermostat 23 for sensing space air temperature, SCAT, in the climate controlled spaces 20 and humidity sensor 25 for sensing the relative humidity in the climate controlled space 20 or the return air duct 26. The controller 100 may be a microprocessor based controller having an associated memory for storing data and an input module for inputting setpoint values and parameter limits.

Figure 3:
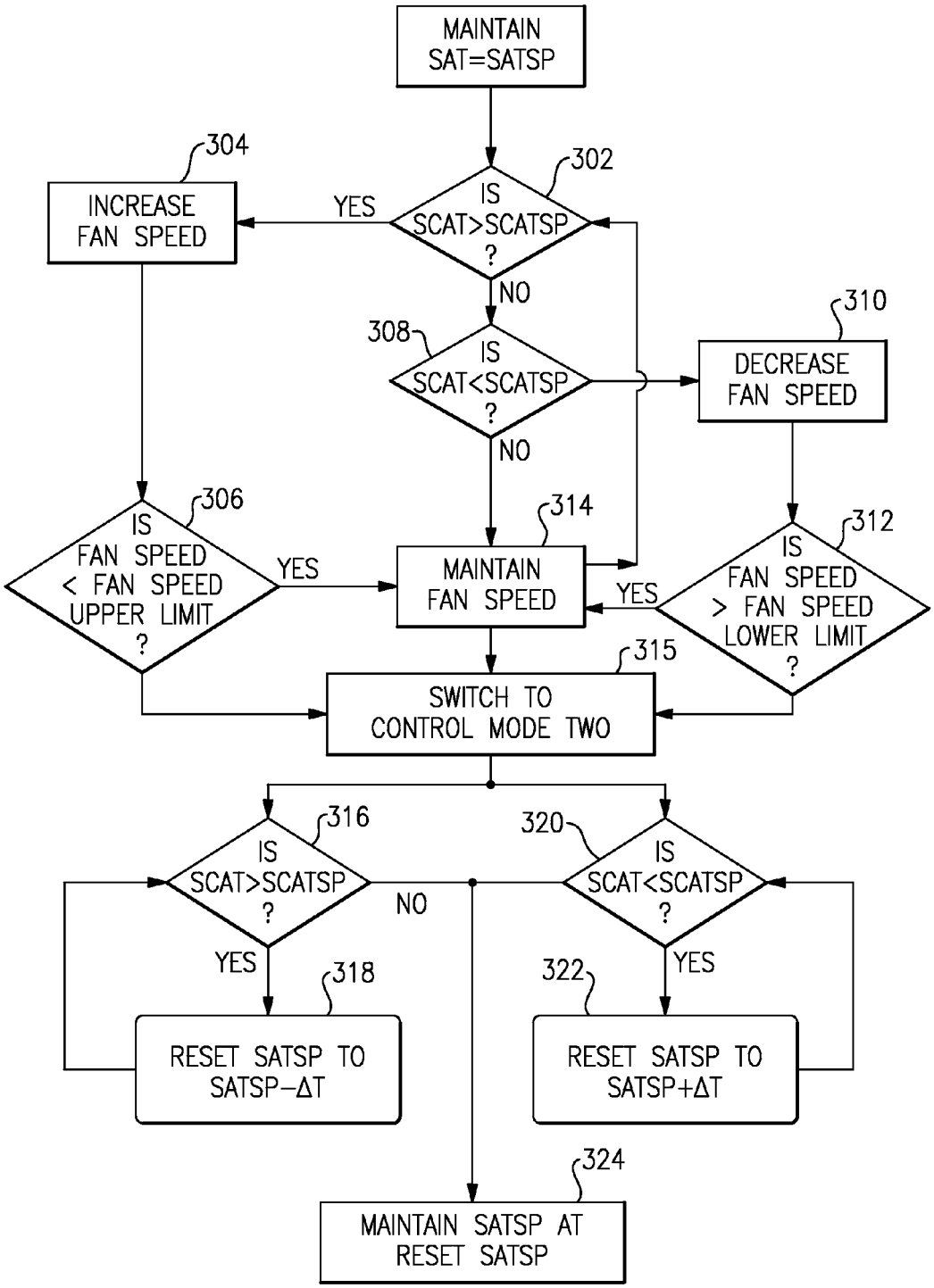
FIG. 3 is a block diagram presenting a flow chart of an exemplary embodiment of a method for controlling the supply of conditioned air to a climate controlled space in accord with a first control mode and a second control mode.
Figure 4:
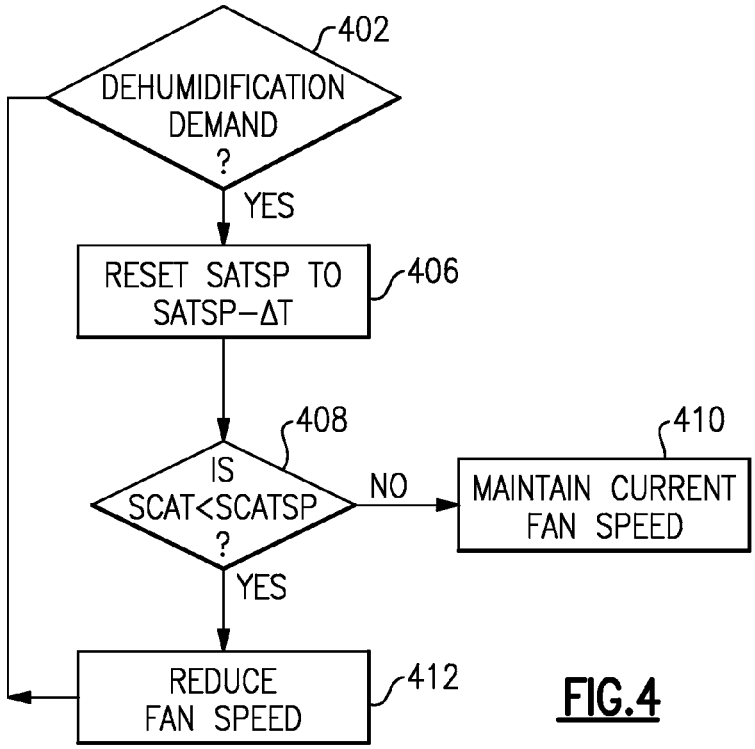
FIG. 4 is a block diagram presenting a flow chart of an exemplary embodiment of a method for controlling the supply of conditioned air to a climate controlled space in accord with a third control mode.

The conditioned air supply system 10 may be operated in any of three control modes. In a first control mode, operation of the system 10 is controlled by the system controller 100, in response to the sensed space comfort air temperature, SCAT, by varying the speed of the variable speed fan 32 to increase or decrease the air flow volume of a constant temperature air flow to the air supply duct 22. In a second control mode, operation of the system 10 is controlled by the system controller 100, in response to the sensed space comfort air temperature, SCAT, by incrementally varying the temperature of a constant air flow volume of air flow to the air supply duct 22. In a third control mode, operation of the system 10 is controlled by the system controller 100, in response to both the sensed comfort air temperature and the sensed relative humidity within the climate controlled spaces 20. Except during operation in the third control mode, operation of the conditioned air supply system 10 transitions back and forth between the first control mode and the second control mode. The third control mode is an override mode which may supplant operation under either of the first control mode or the second control mode. The controller 100 will seamlessly transition operation from the first control mode to the second control mode, from the second control mode to the first control mode, from the first control mode to the third mode, from the second control mode to the third control mode and from the third control mode back to either the first control mode or the second control mode, as appropriate. Operation of the air supply system 10 in the first control mode and the second control mode is illustrated in the flow chart of FIG. 3. Operation of the air supply system 10 in the third control mode, i.e. the override mode, is illustrated in the flow chart of FIG. 4.

In the first control mode, the supply air temperature, SAT, is held constant at a preset setpoint value, SATSP, and the controller 100 varies the speed of the variable speed fan 32 to control the volume of constant temperature supply air that is supplied to the supply air duct 22. At step 302, if the space comfort air temperature, SCAT, is above the temperature setpoint, SCATSP, more cooling is required and the controller 100 increases the air flow volume of supply air flowing through the supply air duct 24 by increasing the speed of the fan 32 at step 304. Conversely, at step 308, if the space comfort air temperature, SCAT, is below the temperature setpoint, SCATSP, less cooling is required and the controller 100 decreases the air flow volume of supply air flowing through the supply air duct 24 by decreasing the speed of the fan 32 at step 310. If SCAT is equal to the setpoint, SCATSP, or within a dead band thereof, the controller 100 will, at step 314, maintain the current fan speed.

However, when the speed of the variable speed fan 32 reaches either its upper speed limit (maximum air flow volume), at step 306, or its lower speed limit (minimum air flow volume), at step 312, further control of the supply air flow volume can not be obtained by increasing the speed of the fan 32 above its upper speed limit or by reducing the speed of the fan 32 below its lower speed limit. At this point, the system controller 100, at step 315, transitions control of the operation of the air supply system 100 to the second control mode, but still in response to the sensed space comfort air temperature, SCAT. In this second control mode, the speed of the variable speed fan 32 is held constant and the controller 100 automatically adjusts supply air temperature setpoint, SATSP, to a new reset setpoint value, SATSP±ΔT.

If the speed of the fan 32 is at its upper limit and, at step 316, the sensed space air temperature, SCAT, is still above its setpoint value, SCATSP, the controller 100, at step 318, adjusts the supply air temperature setpoint downward by an incremental temperature change, ΔT, whereby the reset supply air temperature setpoint RSATSP equals SATSP−ΔT. Thus, although the volume of supply air that is supplied to the supply air duct 24 has not changed, the temperature of the supply air has decreased which upon admission to the climate controlled space 20 will further reduce the comfort air temperature within the climate controlled space. The controller 100 will continue to reset the supply air temperature setpoint through incremental temperature decreases until the sensed space comfort air temperature, SCAT, is reduced to its setpoint value, SCATSP, to maintain the air temperature within the climate controlled spaces 20 within the comfort zone, at step 324.

If the speed of the fan 32 is at its lower limit and cooling demand, at step 322, is such that the sensed space air temperature, SCAT, is still below its setpoint value, SCATSP, the controller 100, at step 322, adjusts the supply air temperature setpoint, SATSP, upward by an incremental temperature change, ΔT, whereby the reset supply air temperature setpoint RSATSP equals SATSP+ΔT. Thus, although the volume of supply air that is supplied to the supply air duct 24 has not changed, the temperature of the supply air has increased which upon admission to the climate controlled space 20 will further raise the comfort air temperature within the climate controlled space. The controller 100 will continue to reset the supply air temperature setpoint through incremental temperature increases until the sensed space comfort air temperature, SCAT, is raised to its setpoint value, SCATSP, to maintain the air temperature within the climate controlled spaces 20 within the comfort zone, at step 324.

In an embodiment, rather then applying a fixed incremental temperature change in resetting the sensed supply air temperature setpoint, SATSP, the controller 100 determines the magnitude of the incremental temperature change by which to the supply air temperature setpoint will be adjusted during a reset step based on the trend in the sensed space air temperature, SCAT, over a current time period. For example, the controller 100 will monitor the sensed space air temperature over an immediately past period of time, for example, such as by way of example but not limitation, a shifting three minute period, and then determine the rate of change in the sensed space air temperature. For example, the controller 100 may determine the rate of change using a best fit line through the most the sensed space air temperatures over that time period, the slope of that best fit line indicative of the rate of change. The controller 100 will then determine the magnitude of the incremental temperature change, ΔT, by which the supply air temperature setpoint will be adjusted in relation to this rate of change.

The third control mode is a dehumidification mode and an override mode. The system controller 100 monitors the relative humidity within the climate controlled space 20 by means of a relative humidity sensor 25 that generates a signal indicative of the local relative humidity, which is relayed to the system controller 100, or a dehumidification demand switch disposed in the space 20 that is activated when the humidity is too high for occupant comfort. The system controller 100 compares the sensed relative humidity to a humidity setpoint. If the sensed relative humidity is higher than the humidity setpoint, the system controller recognizes that a demand for further dehumidification exists. In that event, whether the conditioned air supply system 10 is operating in the first control mode or in the second control mode, the system controller 100 will transition directly to the third mode of operation.

In the air supply system 10, dehumidifying of the air passing through the air handler 30 for supply to the climate controlled space 20 is achieved by condensing moisture from the air traversing the heat exchanger 34. As the air traversing the refrigerant conveying tube bank of the heat exchanger 34 passes over the refrigerant conveying tubes, which may be finned tubes, the air is cooled to a temperature at which moisture in the air will begin to condense out of the air. The lower the temperature to which the supply air is cooled as it traverses the heat exchanger 34, the greater the amount of moisture that will be removed from the supply air and, therefore, the lower the relative humidity level to which the relative humidity of the supply air may be reduced. The dehumidification of the air flow through the heat exchanger 34 is increased by the increase in the refrigerant flow and refrigeration capacity by the refrigerant vapor compression system 40 that receives a signal from the system controller 100 in response to the supply air temperature, SAT, being greater than the supply air temperature setpoint, SATSP, thereby reducing the surface temperature of the tubes or tube and fin surface of the heat exchanger 34. The dehumidification of the air flow through the heat exchanger 34 may also be increased by lowering the air flow volume passing through the air handler 30 in response to the additional cooling being delivered to the air due to the lower leaving air supply temperature, thereby increasing the residence time of the air flow within the heat exchanger 34.

In the third control mode, the system controller 100 not only automatically adjusts the supply air temperature in response to the sensed relative humidity in the climate controlled space 20, SRH, but also varies the fan speed to control air flow volume in response to the sensed comfort air temperature, SCAT. For example, when the system controller 100 transitions into the third control mode at step 402, whether that transition be out of the first control mode or out of the second control mode, in response to a demand for further dehumidification of the air within the climate controlled space 20, the system controller 100 will first adjust the supply air temperature setpoint, SATSP, downward at step 406 by an incremental temperature change, ΔT, whereby the reset supply air temperature setpoint RSATSP equals SATSP−ΔT. The system controller 100 will also signal the compressor of the refrigerant vapor compression system 40 to increase its refrigeration capacity to meet the reset supply air temperature setpoint, RSATSP. The controller 100 will continue to reset the supply air temperature setpoint through incremental temperature decreases, for example by one degree Fahrenheit (1.8 degree Celsius) temperature increments, until the sensed space relative humidity, SRH, is reduced to a level below the relative humidity setpoint value, RHSP, to maintain the relative humidity within the climate controlled space 20 below the relative humidity setpoint, RHSP.

As a consequence of the reduction in temperature of the supply air entering the climate controlled space 20 through the supply air duct 24, the air temperature within the climate controlled space 20 will also tend to drop. At step 408, if the sensed space comfort air temperature, SCAT, drops below the setpoint value SCATSP, the system controller 100 will at step 412 reduce the speed of the variable speed fan 32 to reduce the air flow volume of the now colder supply air being supplied to the climate controlled space 20 through the supply air duct 24. The system controller 100 will reduce the air flow volume by incrementally decreasing the speed of the variable speed fan 34 in response to the sensed space comfort air temperature, SCAT, so as to maintain the sensed space comfort air temperature, SCAT, equal to or within a dead band range of the space comfort air temperature setpoint value, SCATSP. When the sensed space comfort air temperature, SCAT, again equals or exceeds the setpoint value SCATSP, the controller 100 will maintain the current fan speed, step 410, to maintain the current air flow volume. If the sensed humidity level is below the desired setpoint, the conditioned air is being over dehumidified and the refrigerant vapor compression system is expending excess energy to do so. When over dehumidification is detected, the controller 100 may be programmed to reset the supply air temperature setpoint incrementally upward, thereby reducing the energy being expended to condition the supply air.

As discussed hereinbefore, when operating the air supply system 10 in either of the second control mode or the third control mode, the system controller 100 will reset the supply air temperature setpoint, SATSP, through incremental adjustments. However, the system controller will limit the total adjustment that may be made to the supply air temperature setpoint to a pre-programmed limit above or below the base setpoint valve. Thus, in the third control mode, which is an override mode, the incremental adjustments in the supply air temperature setpoint are additive to those previously made in the second control mode. For example, for a base supply air temperature setpoint of 65 degrees Fahrenheit, the total of incremental adjustments might be ±10 degrees Fahrenheit.

When the controller 100 determines that the demand for dehumidification no longer exists, the controller 100 will progressively incrementally increase the supply air temperature setpoint, SATSP, until the original supply air temperature setpoint is reached. At this point, the controller 100 will transition operation into either the first control mode or the second control mode as appropriate.

Figure 5:
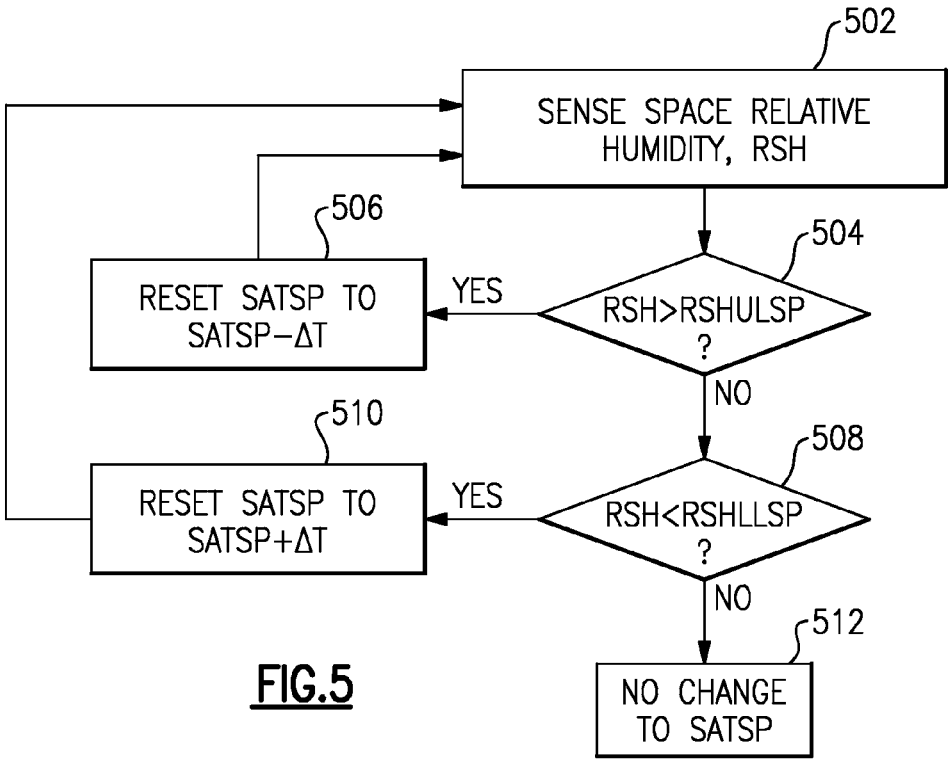
FIG. 5 is a block diagram presenting a flow chart of an exemplary embodiment of a method for controlling the supply of conditioned air to a climate controlled space in accord with a fourth control mode.

The controller 100 may operate the air supply system 10 in a fourth mode, which is an alternate dehumidification mode, as illustrated in the flow chart depicted in FIG. 5. In the fourth control mode, the controller 100 controls the degree of dehumidification of the conditioned air supplied to the climate controlled space 20 in response to a sensed control humidity, such as the relative humidity, SRH, in the climate-controlled space 20 as sensed by the humidity sensor 25, step 502. The controller 100 compares the sensed relative humidity to an upper limit setpoint relative humidity, SRHULSP, at step 504, and also compares the sensed relative humidity to a lower limit setpoint, SRHLLSP, relative humidity, at step 508, and thereby determines whether to increase, to decrease or to maintain the supply air temperature setpoint, SATSP. At step 506, if the sensed relative humidity is less than the upper limit setpoint relative humidity, the relative humidity within the space 20 is too high for occupant comfort and the controller 100 resets the setpoint temperature to which the supply air is cooled to an incrementally lower setpoint temperature, thereby increasing the degree of dehumidification of the supply air. Conversely, at step 510, if the sensed relative humidity is less than the lower limit setpoint relative humidity, the relative humidity within the space 20 is too low for occupant comfort and the controller 100 resets the setpoint temperature to which the supply air is cooled to an incrementally higher setpoint temperature, thereby reducing the degree of dehumidification of the supply air. Typically, the controller 100 will reset the setpoint temperature to which the conditioned air is cooled in increments of one degree Fahrenheit (1.8 degrees Celsius). If the sensed relative humidity is within the range of relative humidity lying between the lower and upper limits thereon, which in the case of the space relative humidity, SRH, represents the occupant comfort range, the controller 100, at step 512, will simply maintain the supply air temperature setpoint at its current setpoint value. In an alternate embodiment, the control relative humidity may be the outdoor air relative humidity.

While the air supply system and method of controlling operation disclosed herein have been particularly shown and described with reference to the exemplary embodiment of a thermal displacement air distribution system as illustrated in the drawing, the air supply system and methods of controlling operation disclosed herein may also be to single zone variable air volume air distribution systems. Further, it will be recognized by those skilled in the art that various modifications may be made to the air supply system and the methods of operation disclosed for application to multiple zone variable air volume air distribution systems, without departing from the spirit and scope of the invention.

Figure 6:
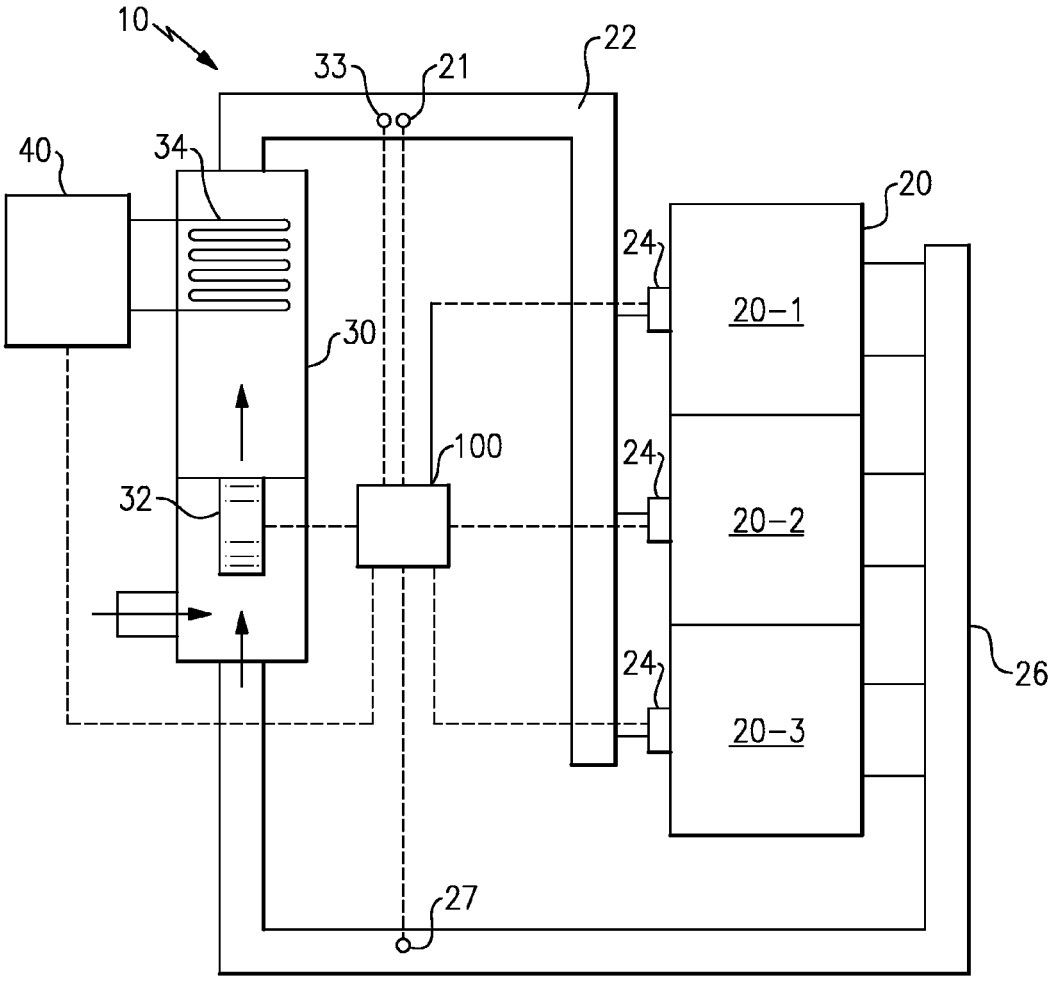
FIG. 6 is a schematic diagram of a system for supplying conditioned air to a multiple zone climate controlled space.

For example, space humidity control in accord with the third control mode or the fourth control mode may be applied to operation of a multiple zone variable air volume (VAV) air supply distribution system associated with a multiple room climate controlled space such as depicted in FIG. 6. The air supply system depicted in FIG. 6 is an VAV air supply distribution system includes an air handler 30 having a variable speed fan 32, a supply air duct 22 which connects the air handler 30 in flow communication with a plurality of air terminals 24 associated with the plurality of zones 20-1, 20-2, 20-3 in the climate controlled space 20, a return air duct 26 which connects the return air registers associated with each of the plurality of zones in the climate controlled space in air flow communication with the air handler 30, a heat exchanger coil 34 associated with a refrigerant vapor compression system 40, and a controller 100. Each of the air terminals 24 includes one or more supply air registers that are provided with dampers controlled by actuators responsive to air temperature within the room with which the air terminal serves. The actuator selectively positions its associated damper at a desired position between fully open and a minimum ventilation position to control the amount of cold air the supply air duct 22 into an upper region of the room through the supply air registers which are located in or near the ceiling of the room. Return air is withdrawn from an upper region of each room through the return air registers which are located in or near the ceiling of the room.

In the multiple zone VAV application, in a first control mode of operation, the controller 100 varies the speed of the variable speed fan 32 to vary the air flow volume of conditioned air supplied at a constant temperature in response to a sensed pressure within the supply air duct 22 so as to maintain the supply duct air pressure, sensed by pressure sensor 33, at a setpoint duct air pressure. In a second control mode of operation, the controller 100 incrementally resets the supply air temperature setpoint to adjust the temperature at which the conditioned air is supplied to the supply air duct 22, while maintaining the air flow volume of the conditioned air constant. In the humidity control mode, the controller 100 incrementally resets the supply air temperature setpoint to adjust the temperature at which the conditioned air is supplied to the supply air duct 22 in response to a sensed control relative humidity, SRH, for example the relative humidity in the return air duct 26, sensed by humidity sensor 27, downstream with respect to air flow of the climate controlled space 20, and varies the speed of the variable speed fan 32 to control air flow volume to the supply air duct 22 in response a sensed pressure within the supply air duct 22 so as to maintain the supply duct air pressure at a setpoint duct air pressure.

The terminology used herein is for the purpose of description, not limitation. Specific structural and functional details disclosed herein are not to be interpreted as limiting, but merely as basis for teaching one skilled in the art to employ the present invention. While the present invention has been particularly shown and described with reference to the exemplary embodiments as illustrated in the drawing, it will be recognized by those skilled in the art that various modifications may be made without departing from the spirit and scope of the invention. Those skilled in the art will also recognize the equivalents that may be substituted for elements described with reference to the exemplary embodiments disclosed herein without departing from the scope of the present invention.

Therefore, it is intended that the present disclosure not be limited to the particular embodiment(s) disclosed as, but that the disclosure will include all embodiments falling within the scope of the appended claims.

We claim:

1. A method for controlling operation of a system for supplying a conditioned air flow at a setpoint air temperature to a climate controlled space, said method comprising:

operating said system under a first control mode in response to a sensed space air temperature by varying a flow volume of the conditioned air flow and maintaining the air temperature of the conditioned air constant at the setpoint air temperature, the flow volume of the conditioned air flow being increased when the sensed space air temperature is greater than a sensed space air temperature setpoint, the flow volume of the conditioned air flow being decreased when the sensed space air temperature is less than the sensed space air temperature setpoint;

determining if the flow volume of the conditioned air is above an upper limit or below a lower limit; and operating said system under a second control mode when the flow volume of the conditioned air flow is above an upper limit or below a lower limit, the second control mode operating in response to the sensed space air temperature by varying the setpoint air temperature of the conditioned air flow and maintaining the flow volume of the conditioned air constant.

2. The method as recited in claim 1 further comprising operating said system under a third control mode in response to a sensed space relative humidity by incrementally varying the setpoint air temperature of the conditioned air flow.

3. The method as recited in claim 1 further comprising operating said system under a third control mode in response to a sensed space relative humidity by incrementally varying the setpoint air temperature of the conditioned air flow and in response to the sensed space air temperature by varying a flow volume of the conditioned air flow.

4. The method as recited in claim 1 further comprising transitioning operation of said system between the first control mode and the second control mode.

5. The method as recited in claim 2 further comprising transitioning operation under either of the first control mode and the second control mode to the third control mode in response to a demand for dehumidifying the air within the climate controlled space.

6. The method as recited in claim 1 further comprising admitting the supply flow of conditioned air into a lower region of the climate controlled space; and withdrawing a return flow of air from an upper region of the climate controlled space.

7. The method as recited in claim 6 wherein admitting the supply flow of conditioned air into a lower region of the climate controlled space comprises admitting the supply flow of conditioned air into a lower region of the climate controlled space at a low air velocity over a floor of the climate controlled space thereby flooding the lower region of the climate controlled space.

8. The method as recited in claim 1 further comprising admitting the supply flow of conditioned air into an upper region of the climate controlled space; and withdrawing a return flow of air from an upper region of the climate controlled space.

9. The method as recited in claim 1 further comprising:

providing a heat exchanger for passing a refrigerant in heat exchange relationship with conditioned air flow to cool the conditioned air flow to the setpoint air temperature;

providing a refrigerant vapor compression system for supplying the refrigerant to the heat exchanger; and controlling the refrigerant vapor compression system independently to maintain the conditioned air temperature supplied to the climate controlled space at the setpoint air temperature.

10. An air supply system for controlling the supply of conditioned air to a climate-controlled space, said system comprising:

an air supply unit including an air mover and a heat exchanger for conditioning the conditioned air;

an air supply duct connecting the air supply unit in air flow communication with the space;

an air return duct connecting the space in air flow communication with the air supply unit; and a controller operatively associated with the air mover and the heat exchanger for controlling the air flow volume of the conditioned air passed to the air supply duct and for controlling the temperature of the conditioned air to a setpoint temperature, in response to a sensed air temperature in the space;

wherein said controller, in a first control mode, adjusts the air flow volume of conditioned air passed to the supply duct in response to the sensed space air temperature in the space, the flow volume of the conditioned air flow being increased when the sensed space air temperature is greater than a sensed space air temperature setpoint, the flow volume of the conditioned air flow being decreased when the sensed space air temperature is less than the sensed space air temperature setpoint;

determining if the flow volume of the conditioned air is above an upper limit or below a lower limit; and operating said system under a second control mode when the flow volume of the conditioned air flow is above an upper limit or below a lower limit, the second control mode operating in response to the sensed space air temperature by varying the setpoint air temperature of the conditioned air flow and maintaining the flow volume of the conditioned air constant.

11. The system as recited in claim 10 wherein said controller adjusts the setpoint temperature in response to a dehumidification demand to increase dehumidifying of the conditioned air.

12. The system as recited in claim 10 further comprising:

at least one air inlet opening to the air supply duct, said at least one air inlet disposed in the space to admit the conditioned air into a lower region of the space; and at least one air outlet opening to the air return duct, said at least one air outlet disposed in the space to withdraw air from an upper region of the space.

13. The system as recited in claim 10 further comprising:

a heat exchanger for passing a refrigerant in heat exchange relationship with conditioned air flow to cool the conditioned air flow to the setpoint air temperature;

a refrigerant vapor compression system for supplying the refrigerant to the heat exchanger; and the controller is operatively associated with the refrigerant vapor compression system for controlling the supply of refrigerant to the heat exchanger to maintain the conditioned air temperature supplied to the climate controlled space at the setpoint air temperature.

* * * * *